US011737510B2

(12) United States Patent
Quach

(10) Patent No.: US 11,737,510 B2
(45) **Date of Patent: *Aug. 29, 2023**

(54) TOE GUIDER DEVICE FOR FOOTWEAR

(71) Applicant: Khang Quach, Los Angeles, CA (US)

(72) Inventor: Khang Quach, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/329,374

(22) Filed: May 25, 2021

(65) Prior Publication Data

US 2021/0274881 A1 Sep. 9, 2021

Related U.S. Application Data

(62) Division of application No. 16/249,860, filed on Jan. 16, 2019, now Pat. No. 11,051,579.

(51) Int. Cl.
*A43B 7/26* (2006.01)
*A43B 3/10* (2006.01)

(52) U.S. Cl.
CPC ..... *A43B 7/26* (2013.01); *A43B 3/10* (2013.01); *A43B 3/105* (2013.01)

(58) Field of Classification Search
CPC ..... A43B 3/126; A43B 3/10; A43B 3/105; A43B 7/126
See application file for complete search history.

(56) References Cited

U.S. PATENT DOCUMENTS 2,506,308 A * 5/1950 Maynier ..... A61F 5/019 602/30
4,017,987 A * 4/1977 Perez, Jr. ..... A43B 3/105 36/11.5
5,802,737 A * 9/1998 Beppu ..... A43B 3/105 36/11.5
6,151,801 A * 11/2000 Frederiksen ..... A43B 3/105 36/11.5
7,980,005 B1 * 7/2011 Young ..... A43B 3/0047 36/11.5
D654,670 S * 2/2012 Nelson ..... D2/917
D670,492 S * 11/2012 Chenciner ..... D2/972
8,739,434 B2 * 6/2014 Bishop ..... A43B 3/105 36/11.5
10,231,506 B2 * 3/2019 Chenciner ..... A43C 1/06
11,051,579 B2 * 7/2021 Quach ..... A43B 3/105
2005/0229430 A1 * 10/2005 Takaba ..... A43B 7/26 36/11.5
2008/0086918 A1 * 4/2008 Chung ..... A43B 7/26 36/141
2013/0305564 A1 * 11/2013 Thatcher ..... A43B 13/127 36/44
2017/0119086 A1 * 5/2017 Hillyer ..... A43B 3/103
2018/0153250 A1 * 6/2018 Laird ..... A43B 3/105
2019/0321209 A1 * 10/2019 Hatzis ..... A61F 5/019

* cited by examiner

*Primary Examiner* — Ted Kavanaugh
(74) *Attorney, Agent, or Firm* — Raymond Y. Chan; David and Raymond Patent Firm

(57) ABSTRACT

A footwear includes a shoe sole, a shoe upper member coupled on the shoe sole, and a toe guider device which includes first and second spacers. Bottom ends of the first and second toe spacers are retained by the shoe sole while top ends of the first and second toe spacers are retained by the shoe upper. The first toe spacer is retained for being worn between first and second toes of a wearer. The second toe spacer is retained for being worn between second and third toes of the wearer.

14 Claims, 5 Drawing Sheets

TOE GUIDER DEVICE FOR FOOTWEAR

CROSS REFERENCE OF RELATED APPLICATION

This application is a Divisional application that claims the benefit of priority under 35 U.S.C. § 120 to a non-provisional application, application Ser. No. 16/249,860, filed Jan. 16, 2019, which is incorporated herewith by reference in its entirety.

BACKGROUND OF THE PRESENT INVENTION

Field of Invention

The present invention relates to footwear, and more particularly to a toe guider device for the footwear, which provides a two-point toe retention for preventing any unwanted movement of the foot with respect to the footwear and for helping align and straighten the toes to relieve pressure on bunions.

Description of Related Arts

Footwear generally comprises a shoe sole and a shoe upper memberattached thereon, and defines a hindfoot portion, a midfoot portion, and a forefoot portion. Accordingly, the footwear is intended to protect and comfort the wearer's foot. A bad designed footwear may cause the wearer to suffer foot pain due to lack of arch support, cushion support, and tendinitis. In other words, a good footwear is constructed to have a cushion support at the hindfoot portion and an arch support at the mid portion.

A tapered shoe head may cause many foot problems, such as hammertoes. To have healthy feet, the footwear should have a wide forefoot portion, such that the footwear provides more wiggle room for the wearer's toes. However, performance footwear, such as running shoe, is designed to have limited wiggle room to prevent any unwanted toe movement during exercise. In addition, flip-flop is generally constructed to have the shoe sole with the V-shaped strap, wherein the flip-flop is an open type of footwear that leaves all the toes exposed. In other words, in order to hold the wearer's toes in position, the footwear, such as running shoe, may provide limited wiggle room for the wearer's toes. Alternatively, the footwear, such as flip-flop, may provide a single point toe spacer between the first toe and the second toe to limit the forefoot movement of the wearer. However, these footwear are bad for the wearer that the wearer may suffer foot pain due to the throbbing and tenderness in the toes.

Furthermore, a sandal, which is an open type of footwear, may comprise a toe nail polish guard for pedicure procedure. Accordingly, the toe nail polish guard comprises four toe separators spacedly and upwardly extended from the shoe sole for separating the toes of the wearer for easily grooming the toenails and applying polish to the toes. Since this sandal is the open type of footwear, the top ends of the toe separators are free ends without any retention or support. If the toe separators are made of sturdy material to minimize the unwanted movement thereof, the wearer will wear the sandal uncomfortably and may not able to walk with toe pain. If the toe separators are made of soft material to provide a comfortable wearing feel for the wearer, the toe separators are not rigid enough to limit the forefoot movement of the wearer. In other words, this sandal with the toe nail polish guard is only designed for temporary use during the pedicure procedure but not designed for daily use such as walking or even running.

SUMMARY OF THE PRESENT INVENTION

The invention is advantageous in that it provides a toe guider device for the footwear, which provides a two-point toe retention for preventing any unwanted movement of the foot with respect to the footwear and for helping align and straighten the toes to relieve pressure on bunions.

Another advantage of the invention is to provide a toe guider device for the footwear adapted for separating the big toe, the index toe and the middle toe and providing a first space between the big toe and the index toe and a second space between the index toe and the middle toe for relaxing and hammer toe correction.

Another advantage of the toe guider device for footwear according to the invention is that at least the spacer of the guider device adapted to be positioned between the big toe and the index toe has an elongated cross section to extend to the tip portions of the big toe and the index toe to ensure a complete separation between the big toe and the index toe.

Another advantage of the toe guider device for the footwear according to the invention is that the toe guider device is retained by the shoe sole and the shoe upper member to prevent any unwanted movement of the toe guider device.

Another advantage of the invention is to provide a toe guider device for the footwear, wherein the toe guider device is able to incorporate with any existing footwear, such as sandal and shoe, to correct toes and to reduce foot pain, such that the wearer is able to wear the footwear for daily use such as walking or running.

Another advantage of the invention is to provide a toe guider device for the footwear, which does not require altering the original structural design of the footwear, so as to minimize the manufacturing cost of the footwear that incorporates the toe guider device.

Another advantage of the invention is to provide a toe guider device for the footwear, wherein no expensive or complicated structure is required to employ the present invention in order to achieve the above mentioned objectives. Therefore, the present invention successfully provides an economic and efficient solution to provide a two-point toe retention for preventing any unwanted movement of the foot with respect to the footwear and for helping align and straighten the toes.

Additional advantages and features of the invention will become apparent from the description which follows, and may be realized by means of the instrumentalities and combinations particular point out in the appended claims.

According to the present invention, the foregoing and other objects and advantages are attained by a footwear includes a shoe sole, a shoe upper membercoupled on the shoe sole, and a toe guider device which includes first and second spacers. Bottom ends of the first and second toe spacers are retained by the shoe sole while top ends of the first and second toe spacers are retained by the shoe upper. The first toe spacer is retained for being worn between first and second toes of a wearer. The second toe spacer is retained for being worn between second and third toes of the wearer.

In accordance with another aspect of the invention, the present invention comprises a method of manufacturing a footwear which comprises the following steps.

(A) Form a shoe sole and a shoe upper.

(B) Attach the shoe upper member on the shoe sole.

(C) Form a first toe spacer between the shoe sole and the shoe upper member at a position that a bottom end of the first toe spacer is retained by the shoe sole while a top end of the first toe spacer is retained by the shoe upper member to retain the first toe spacer for being worn between first and second toes of an wearer.

(D) Form a second toe spacer between the shoe sole and the shoe upper member at a position that a bottom end of the second toe spacer is retained by the shoe sole while a top end of the second toe spacer is retained by the shoe upper member to retain the second toe spacer for being worn between second and third toes of the wearer.

In accordance with another aspect of the invention, the present invention comprises a sandal which comprises a shoe sole, a strap having two strap ends attached on the shoe sole, and a toe guider device which comprises first and second toe spacers.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
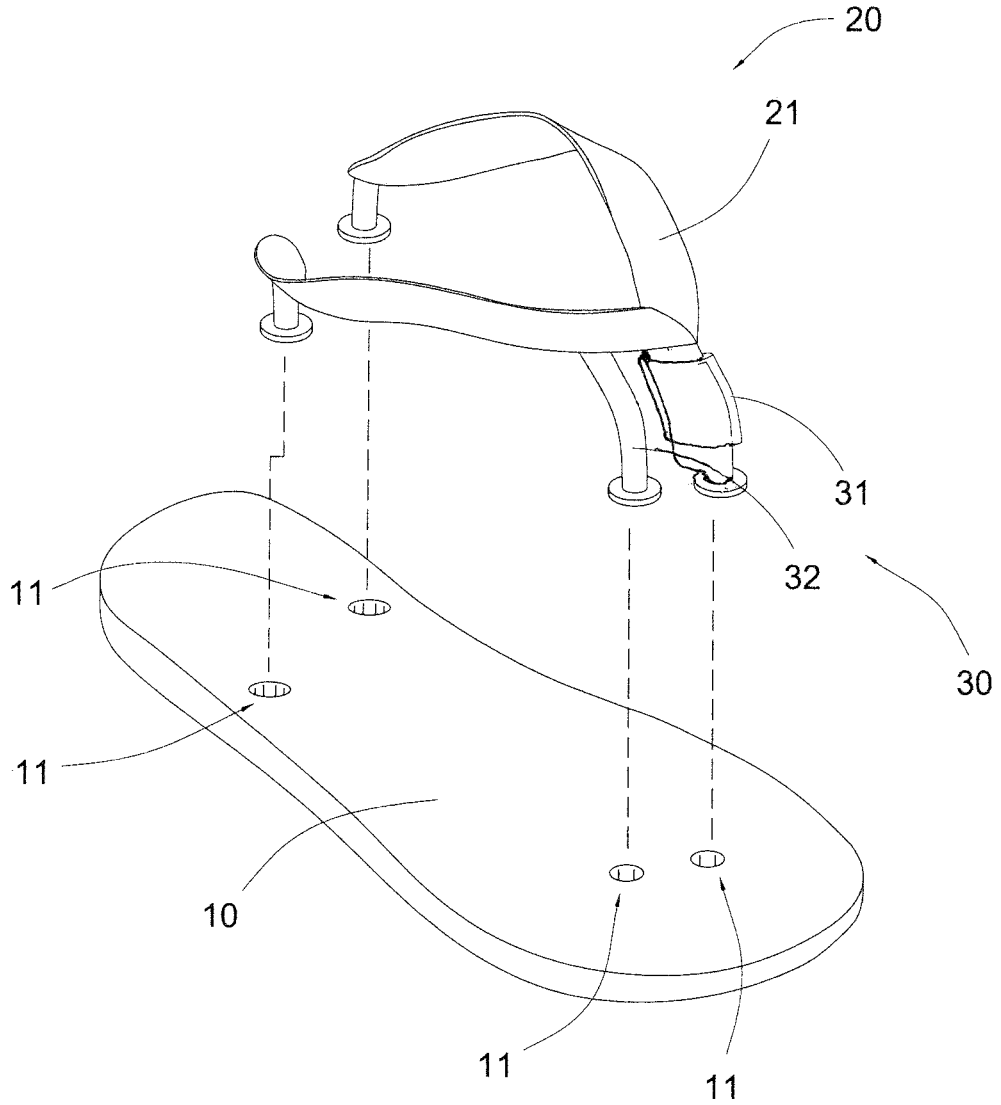
FIG. 1 is an exploded perspective view of a footwear with a toe guider device according to a first preferred embodiment of the present invention.
Figure 2:
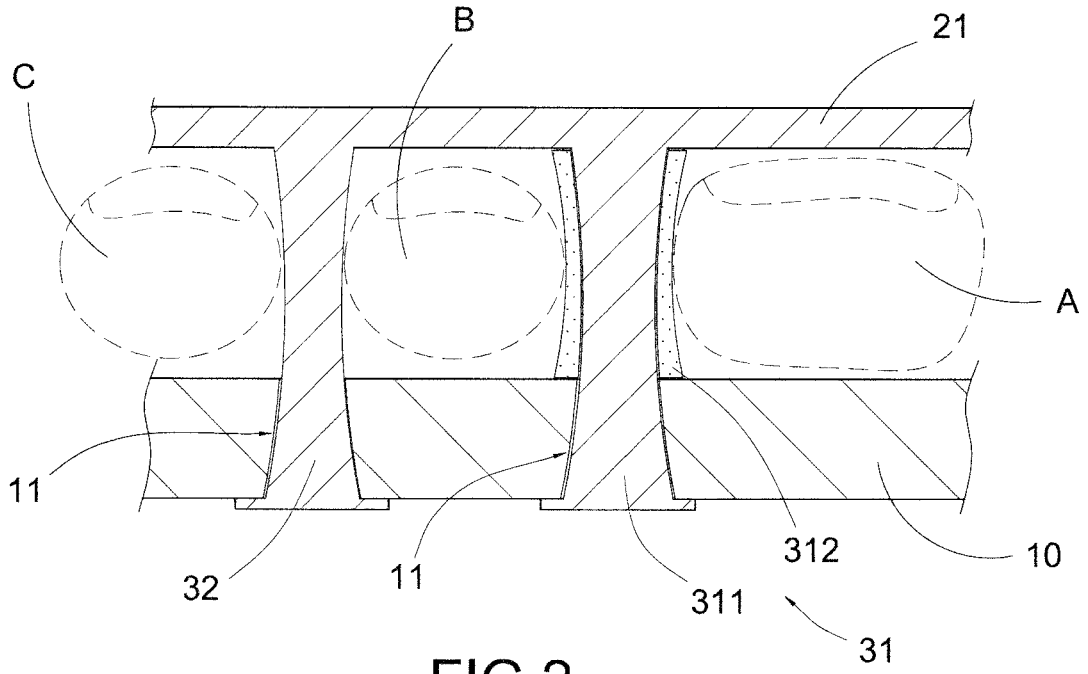
FIG. 2 is a sectional view of the toe guider device of the footwear according to the above first preferred embodiment of the present invention.

Referring to FIGS. 1 and 2 of the drawings, a footwear according to a first embodiment of the present invention is illustrated. In this embodiment, the footwear is an open type of footwear, wherein the footwear is embodied and constructed as a sandal or a flip flop. The footwear comprises a shoe sole 10, a shoe upper member 20 coupled on the shoe sole 10, and a toe guider device 30 retained between the shoe sole 10 and the shoe upper member 20. Accordingly, the toe guider device 30 comprises a first spacer 31 and a second spacer 32 spaced apart with each other to provide a two-point toe retention for preventing any unwanted movement of the foot with respect to the footwear and for helping align and straighten the toes to relieve pressure on bunions.

As shown in FIGS. 1 and 2, the first spacer 31 is extended between the shoe sole 10 and the shoe upper member 20, wherein the first spacer 31 has a bottom end retained by the shoe sole 10 and a top end retained by the shoe upper member 20. Therefore, the first spacer 31 is retained for being worn between the first toe A (big toe) and the second toe B (index toe) of the wearer.

The second spacer 32 is extended between the shoe sole 10 and the shoe upper member 20, wherein the second spacer 32 has a bottom end retained by the shoe sole 10 and a top end retained by the shoe upper member 20. Therefore, the second spacer 32 is retained for being worn between the second toe B (index toe) and the third toe C (middle toe) of the wearer.

According to the first embodiment, the shoe sole 10 has a bottom sturdy side and a top cushion side, wherein the shoe sole 10 has a plurality of attachment slots 11 formed thereat to engage with two side ends of the shoe upper member 20 and the bottom ends of the first and second toe spacers 31, 32 respectively. In one embodiment, each of the attachment slots 11 is a through hole, wherein the side ends of the shoe upper member 20 and the bottom ends of the first and second toe spacers 31, 32 are extended through the attachment slots 11 to attach to the shoe sole 10.

According to this embodiment, the shoe upper member 20 is embodied as example to comprise a strap 21, having a V-shape, defines the side ends as two free ends of the strap 21. The strap 21, which can be made of plastic, fabric, leather, or the like, is attached on the shoe sole 10. Alternatively, the shoe upper member 20 can be an elongated straight strap or a flap, wherein the side ends are defined as two side edges of the shoe upper member 20.

According to the preferred embodiment, the first and second toe spacers 31, 32 are preferably made of soft gel material to soothe and soften skins around the toes. As the first and second toe spacers 31, 32 being retained by the shoe sole 10 and the shoe upper member 20, a height of each of the first and second toe spacers 31, 32 is equal or larger than a distance between the shoe sole 10 and the shoe upper member 20.

A width of the first toe spacer 31 is larger than a width of the second toe spacer 32. It is because a toe gap between the first toe A and the second toe B is larger than a toe gap between the second toe B and the third toe C of the wearer. Therefore, the wider first toe spacer 31 will fit the wider toe gap between the first toe A and the second toe B while the narrower second to spacer 32 will fit the narrower toe gap between the second toe B and the third toe C. Furthermore, each of the first and second toe spacers 31, 32 has two opposed curving sidewalls that the width of each of the second toe spacers 31, 32 is gradually reducing towards a mid-portion thereof. It is worth mentioning that the width between the first and second toe spacers 31, 32 should be compared at the same portion. In other words, the width of the mid-portion of the first toe spacer 31 is larger than the width of the mid-portion of the second toe spacer 32. Accordingly, the curving sidewalls of the first and second toe spacers 31, 32 are configured to fit the curvature of the side surfaces of the toes so as to ensure the toe guider device 30 of the present invention being worn comfortably.

At least one of the bottom ends of the first and second toe spacers 31, 32 is attached to the shoe sole 10. At least one of the top ends of the first and second toe spacers 31, 32 is integrally extended from the shoe upper member 20. As shown in FIG. 2, both the bottom ends of the first and second toe spacers 31, 32 are attached to the shoe sole 10 via two of the attachment slots 11 respectively. In one embodiment, the bottom ends of the first and second toe spacers 31, 32 are two enlarged stopper ends extended to the bottom side of the shoe sole 10 through the attachment slots 11. Both the top ends of the first and second toe spacers 31, 32 are integrally extended from the strap 21 of the shoe upper member 20. In other words, the first and second toe spacers 31, 32 can be formed at the same when manufacturing the shoe upper member 20 during the manufacturing process thereof, such as mold injection, sewing, 3D printing, and/or etc.

In one embodiment, at least one of the first and second toe spacers 31, 32 comprises a core support and a core sleeve. As shown in FIG. 2, only the first toe spacer 31 is constructed to have the core support 311 and the core sleeve 312, wherein the core support 311 is extended between the shoe sole 10 and the shoe upper member 20, and is coaxially received along the core sleeve 312. In particular, the top end of the core support 311 is integrally extended from the shoe upper member 20 while the bottom end of the core support 311 is attached to the shoe sole 10 via the attachment slot 11. The curving sidewalls are defined at the core sleeve 312. It is worth mentioning that the material of the core support 311 can be the same as the material of the core sleeve 312. Preferably, the material of the core support 311 is different from the material of the core sleeve 312. The core support 311 is made of relatively sturdy material and the core sleeve 312 is made of soft material, such as soft gel material. It is worth mentioning that the second toe spacer 32 can also be constructed as the first toe spacer 31 to have the core support and the core sleeve. Alternatively, the first toe spacer 31 can also be constructed as the second toe spacer 32 to have the single core configuration.

Figure 3:
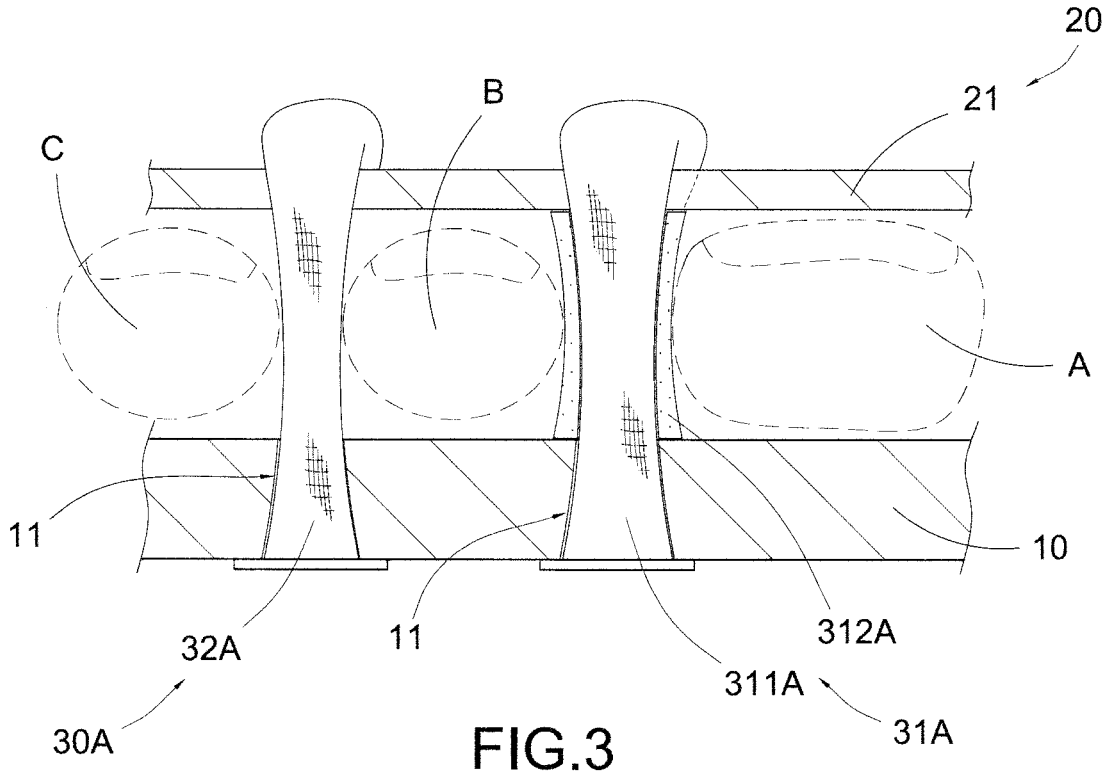
FIG. 3 illustrates an alternative mode of the toe guider device of the footwear according to the above first preferred embodiment of the present invention.

FIG. 3 illustrates an alternative mode of the toe guider device 30A, wherein the first and second toe spacers 31A, 32A are made of different material from the first and second toe spacers 31, 32 in FIG. 2. Accordingly, the first and second toe spacers 31, 32 are preferably made of plastic. The first and second toe spacers 31A, 32A are preferably made of fabric material. In one embodiment, the fabric string is woven to form each of the first and second toe spacers 31A, 32A. Accordingly, at least one of the top ends of the first and second toe spacers 31A, 32A is attached to the shoe upper member 20. As shown in FIG. 3, both the top ends of the first and second toe spacers 31A, 32A are attached to the shoe upper member 20, wherein the first and second toe spacers 31A, 32A are tied to the shoe upper member 20. In one embodiment, each top end of the first and second toe spacers 31A, 32A forms a loop end, wherein the strap 21 passes through the loop ends to couple with the first and second toe spacers 31A, 32A. It is worth mentioning that at least one of the first and second toe spacers 31A, 32A can be integrally formed with the shoe upper member 20 when the material of the shoe upper member 20 is the same as the first and/or toe spacers 31A, 32A.

Furthermore, at least one of the first and second toe spacers 31A, 32A comprises a core support and a core sleeve. As shown in FIG. 3, only the first toe spacer 31A is constructed to have the core support 311A and the core sleeve 312A, wherein the core support 311A is extended between the shoe sole 10A and the shoe upper member 20A, and is coaxially received along the core sleeve 312A. In particular, the top end of the core support 311A is attached to the shoe upper member 20 while the bottom end of the core support 311A is attached to the shoe sole 10 via the attachment slot 11. Preferably, the material of the core support 311A is different from the material of the core sleeve 312A. The core support 311A is made of fabric material and the core sleeve 312A is made of soft material, such as soft gel material. It is worth mentioning that the second toe spacer 32A can also be constructed as the first toe spacer 31A to have the core support and the core sleeve. Alternatively, the first toe spacer 31A can also be constructed as the second toe spacer 32A to have the single core configuration.

Figure 4:
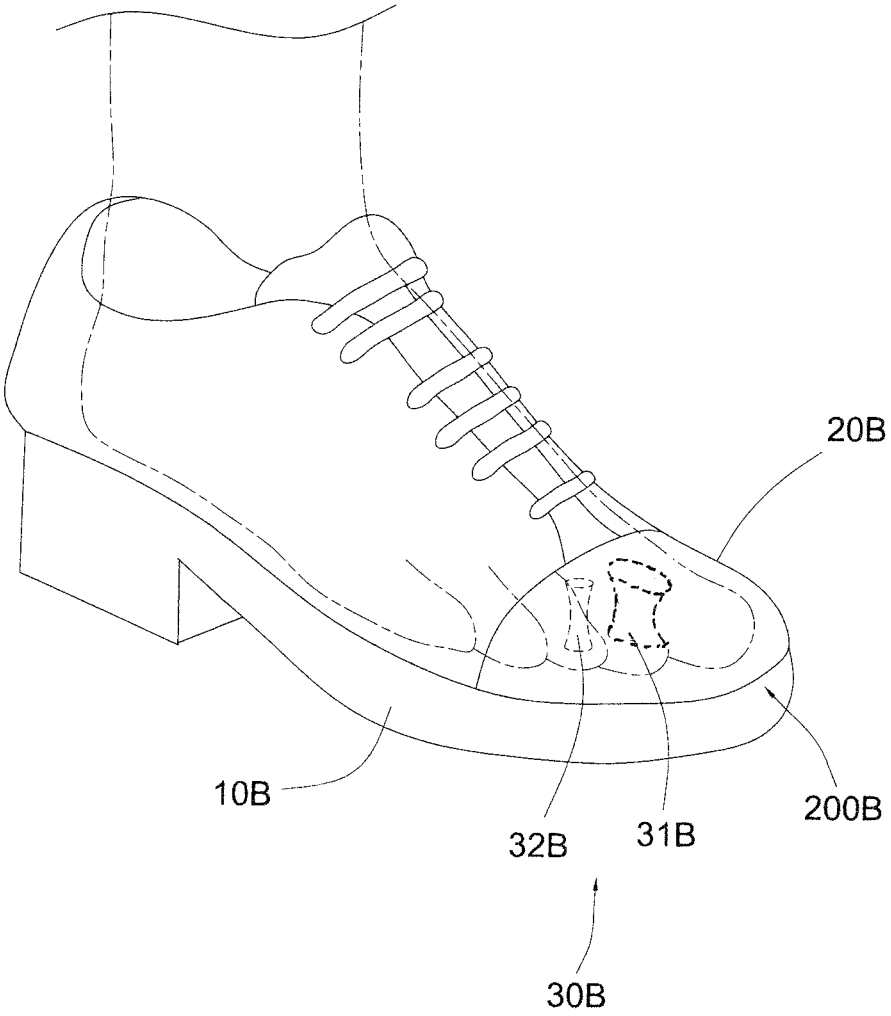
FIG. 4 is a perspective view of a footwear with a toe guider device according to a second preferred embodiment of the present invention.
Figure 5:
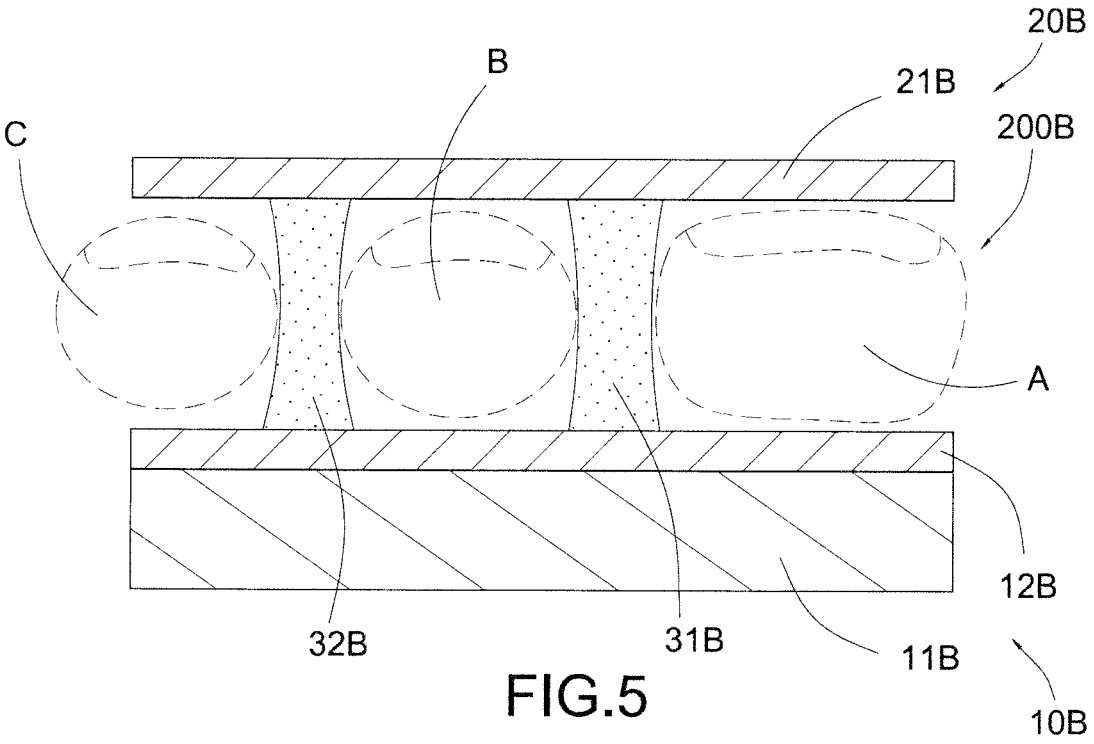
FIG. 5 is a sectional view of the toe guider device of the footwear according to the above second preferred embodiment of the present invention.

As shown in FIGS. 4 and 5, a footwear according to a second embodiment illustrates an alternative mode of the first embodiment, wherein the footwear is a closed type of footwear and is embodied and constructed as a shoe according to the second embodiment. The footwear comprises a shoe sole 10B, a shoe upper member 20B coupled on the shoe sole 10B, and a toe guider device 30B retained between the shoe sole 10B and the shoe upper member 20B.

The shoe sole 10B comprises an outsole 11B and an insole 12B overlapped thereon. The shoe upper member 20B comprises a toe cover 21B attached on the shoe sole 10B to define a toe cavity 200B therebetween, wherein the toe guider device 30B is supported within the toe cavity 200B.

The toe guider device 30B comprises first and second toe spacers 31B, 32B retained between the shoe sole 10B and the shoe upper member 20B. The first spacer 31B has a bottom end retained by the shoe sole 10B and a top end retained by the shoe upper member 20B, wherein the first spacer 31B is retained for being worn between the first toe A and the second toe B of the wearer. The second spacer 32B has a bottom end retained by the shoe sole 10B and a top end retained by the shoe upper member 20B, wherein the second spacer 32B is retained for being worn between the second toe B and the third toe C of the wearer. The contour configuration of each of the first and second toe spacers 31B, 32B of the second embodiment is the same as that of each of the first and second toe spacers 31, 32 of the first embodiment. That is, a height of each of the first and second toe spacers 31B, 32B is equal or larger than a distance between the shoe sole 10B and the shoe upper member 20B. A width of the first toe spacer 31B is larger than a width of the second toe spacer 32B. Furthermore, each of the first and second toe spacers 31B, 32B has two opposed curving sidewalls that the width of each of the second toe spacers 31B, 32B is gradually reducing towards a mid-portion thereof.

At least one of the bottom ends of the first and second toe spacers 31B, 32B is integrally extended from the shoe sole 10B. At least one of the top ends of the first and second toe spacers 31B, 32B is integrally extended from the shoe upper member 20B. As shown in FIG. 5, both the bottom ends of the first and second toe spacers 31B, 32B are integrally extended from the insole 12B of the shoe sole 10B. Both the top ends of the first and second toe spacers 31B, 32B are integrally extended from the toe cover 21B of the shoe upper member 20B. In one embodiment, the first and second toe spacers 31B, 32B are glued to the insole 12B to integrate the bottom ends of the first and second toe spacers 31B, 32B with the insole 12B. The first and second toe spacers 31B, 32B are glued to the toe cover 21B to integrate the top ends of the first and second toe spacers 31B, 32B with the toe cover 21B. It is worth mentioning that each of the first and second toe spacers 31B, 32B can be constructed with the core support and the core sleeve as configured as the first and second toe spacers 31, 32 in the first embodiment.

Figure 6:
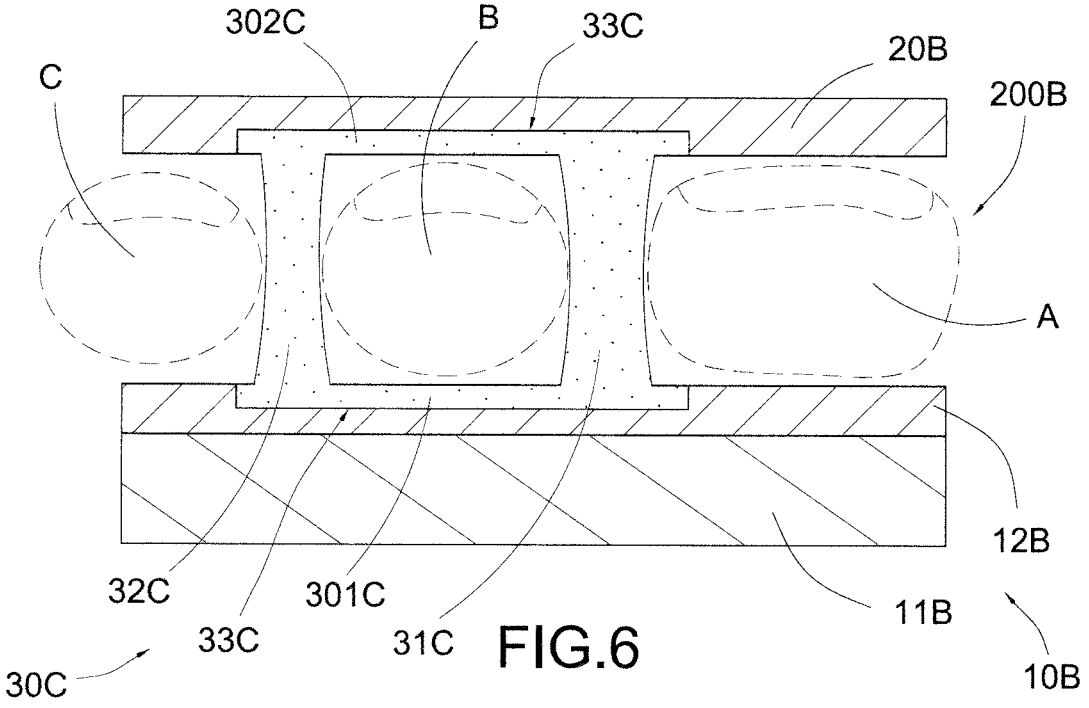
FIG. 6 illustrates an alternative mode of the toe guider device of the footwear according to the above second preferred embodiment of the present invention.

FIG. 6 illustrates an alternative mode of the toe guider device 30C of the second embodiment, wherein the first and second toe spacers 31C, 32C are integrated to form a one-piece integrated member. Accordingly, the bottom ends of the first and second toe spacers 31C, 32C are integrated to form an enlarged bottom platform 301C. The top ends of the first and second toe spacers 31C, 32C are integrated to form an enlarged top platform 302C.

The toe guider device 30C further has two retention cavities 33C indently formed at the shoe sole 10B and the shoe upper member 20B respectively to receive the top and bottom ends of the first and second toe spacers 31C, 32C so as to retain the first and second toe spacers 31C, 32C between the shoe sole 10B and the shoe upper member 20B. As shown in FIG. 6, the retention cavities 33C are formed at the insole 12B of the shoe sole 10B and an inner side of the toe cover 21B of the shoe upper member 20B. Moreover, the bottom platform 301C and the top platform 302C are received at the retention cavities 33C respectively to retain the toe guider device 30C between the shoe sole 10C and the shoe upper member 20C. In other words, the toe guider device 30C can be detached from the shoe sole 10C and the shoe upper member 20B and can be placed back therebetween via the retention cavities 33C. It is worth mentioning that the retention cavities 33C can be replaced by two detachable fasteners, such as hook and loop fasteners, provided at the shoe sole 10B and the shoe upper member 20B respectively to detachably fasten the top and bottom ends of the first and second toe spacers 31C, 32C, preferably via the top platform 302C and the bottom platform 301C, so as to retain the first and second toe spacers 31C, 32C between the shoe sole 10B and the shoe upper member 20B.

In some embodiments, as shown in FIGS. 1 and 4, the first toe spacer 31, 31A, 31B, 31C has an elongated cross section, for example in oval shape, in ellipse shape, elongated shape with round ends, or elongated shape with concaved middle portion as shown in FIG. 4, to extend to the tip portions of the first toe and the second toe so as to ensure a complete separation between the first toe and the second toe of the wearer. The first and second toe spacers 31, 31A, 31B, 31C and 32, 32A, 32B, 32C positioned between the first toe and the second toe and between the second toe and the third toe respectively substantially provide a first space between the first toe and the second toe and a second space between the second toe and the middle toe can substantially provide relaxing of the toes and correction of the hammer toe of the wearer.

Figure 7:
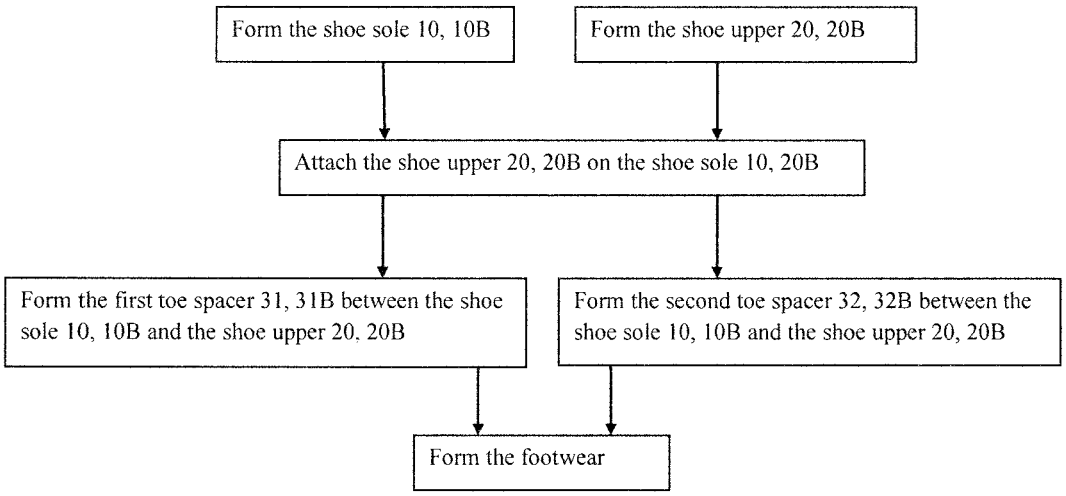
FIG. 7 illustrates a method of manufacturing method of the footwear according to the above first and second embodiments of the present invention.

FIG. 7 illustrates a manufacturing method of the footwear, which comprises the following steps.

(1) Form the shoe sole 10, 10B and the shoe upper member 20, 20B.

(2) Attach the shoe upper member 20, 20B on the shoe sole 10, 20B. Accordingly, the shoe upper member 20 is formed to have the strap 21 being attached on the shoe sole 10 to form the flip flop as the first embodiment while the shoe upper member 20B is formed to have the toe cover 21B being attached on the shoe sole 10B to form the shoe as the second embodiment.

(3) Form the first toe spacer 31, 31B between the shoe sole 10, 10B and the shoe upper member 20, 20B at a position that the bottom end of the first toe spacer 31, 31B is retained by the shoe sole 10, 10B while the top end of the first toe spacer 32, 32B is retained by the shoe upper member 20, 20B to retain the first toe spacer 31, 31B for being worn between first and second toes A, B of the wearer.

(4) Form the second toe spacer 32, 32B between the shoe sole 10, 10B and the shoe upper member 20, 20B at a position that the bottom end of the second toe spacer 32, 32B is retained by the shoe sole 10, 10B while the top end of the second toe spacer 32, 32B is retained by the shoe upper member 20, 20B to retain the second toe spacer 32, 32B for being worn between second and third toes B, C of the wearer.

Accordingly, all the features in the first and second embodiments and their alternatives are interchangeable to achieve the objective of the present invention. For example, the first toe spacer 31, 31A, 31B, 31C and the second toe spacer 32, 32A, 32B, 32C are interchangeable that the bottom ends of the first and second toe spacers 31, 31A, 31B, 31C, 32, 32A, 32B, 32C can be either integrated with the shoe sole 10, 10A, 10B, 10C or attached thereto, and the top ends of the first and second toe spacers 31, 31A, 31B, 31C, 32, 32A, 32B, 32C can be either integrated with the shoe upper member 20, 20A, 20B, 20C or attached thereto. The toe guider device 30, 30A, 30B, 30C can be incorporated with any footwear having the shoe sole 10, 10A, 10B, 10C and the shoe upper member 20, 20A, 20B, 20C. Likewise, the core support and the core sleeve can be formed at the first and/or second toe spacers according to the first and second embodiments and their alternatively. For example, the first spacer 31B of the second embodiment can be constructed to have the core support and the core sleeve as shown in FIGS. 2 and 3.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A footwear, comprising:

a shoe sole;

a shoe upper member coupled on said shoe sole; and a toe guider device consisting of a first toe spacer and a second toe spacer, wherein bottom ends of said first and second toe spacers are retained by said shoe sole while top ends of said first toe spacer and said second toe spacer are retained by said shoe upper member, such that said first and second toe spacers are spacedly held at a position that said first toe spacer is arranged for being worn between first and second toes of an wearer and said second toe spacer is arranged for being worn between second and third toes of the wearer, wherein a width of said first toe spacer is lamer than a width of said second toe spacer, wherein said first toe spacer has two first opposed curving sidewalls such that a width of said first toe spacer is gradually reducing towards a mid-portion of said first toe spacer and said second toe spacer has two second opposed curving sidewalls such that a width of said second toe spacer is gradually reducing towards a mid-portion of said second toe spacer, wherein said mid-portion of said first toe spacer has a width lamer than that of said mid-portion of said second toe spacer, thereby each of said first and second opposed curving sidewalls has a curvature configured for fitting a curvature of side surfaces of the toes of the wearer.

2. The footwear, as recited in claim 1, wherein at least one of said bottom ends of said first and second toe spacers is integrally extended from said shoe sole.

3. The footwear, as recited in claim 2, wherein said toe guider device has two retention cavities indently formed at said shoe sole and said shoe upper member respectively to receive said top and bottom ends of said first and second toe spacers so as to retain said first and second toe spacers between said shoe sole and said shoe upper.

4. The footwear, as recited in claim 1, wherein said toe guider device has two retention cavities indently formed at said shoe sole and said shoe upper member respectively to receive said top and bottom ends of said first and second toe spacers so as to retain said first and second toe spacers between said shoe sole and said shoe upper.

5. The footwear, as recited in claim 1, wherein said shoe upper member comprises a toe cover attached on said shoe sole to form a toe cavity that said toe guider device is supported therewithin.

6. The footwear, as recited in claim 1, wherein said bottom ends of said first and second toe spacers are integrated to form an enlarged bottom platform while said top ends of said first and second toe spacers are integrated to form an enlarged top platform.

7. The footwear, as recited in claim 1, wherein said bottom ends of said first and second toe spacers are integrated to form an enlarged bottom platform while said top ends of said first and second toe spacers are integrated to form an enlarged top platform.

8. The footwear, as recited in claim 1, wherein said first toe spacer is constructed to have a core sleeve and a core support, wherein said core support is extended between said shoe sole and said shoe upper member and coaxially extended along said core sleeve, wherein said two first opposed curving sidewalls are defined at said core sleeve.

9. A method of manufacturing a footwear, comprising steps of:

(a) forming a shoe sole and a shoe upper member;

(b) attaching said shoe upper member on said shoe sole;

(c) forming a toe guider device, consisting of a first toe spacer and a second toe spacer;

(d) forming the first toe spacer between said shoe sole and said shoe upper member at a position that a bottom end of said first toe spacer is retained by said shoe sole while a top end of said first toe spacer is retained by said shoe upper member to retain said first toe spacer for being worn between first and second toes of a wearer, wherein said first toe spacer has two first opposed curving sidewalls such that a width of said first toe spacer is gradually reducing towards a mid-portion of said first toe spacer; and (e) forming the second toe spacer, having a width smaller than said first toe spacer, between said shoe sole and said shoe upper member at a position that a bottom end of said second toe spacer is retained by said shoe sole while a top end of said second toe spacer is retained by said shoe upper member to retain said second toe spacer for being worn between second and third toes of the wearer, wherein said second toe spacer has two second opposed curving sidewalls such that a width of said second toe spacer is gradually reducing towards a mid-portion of said second toe spacer, wherein said mid-portion of said first toe spacer has a width lamer than that of said mid-portion of said second toe spacer, such that each of said first and second opposed curving sidewalls has a curvature configured for fitting a curvature of side surfaces of the toes of the wearer.

10. The method as recited in claim 9 wherein, in the step (d) and step (e), at least one of said bottom ends of said first and second toe spacers is integrally extended from said shoe upper.

11. The method, as recited in claim 9, wherein said shoe upper member comprises a toe cover attached on said shoe sole to form a toe cavity that said toe guider device is supported therewithin.

12. The method, as recited in claim 9, wherein said shoe upper member comprises a toe cover attached on said shoe sole to form a toe cavity that said toe guider device is supported therewithin.

13. The method, as recited in claim 9, wherein said bottom ends of said first and second toe spacers are integrated to form an enlarged bottom platform while said top ends of said first and second toe spacers are integrated to form an enlarged top platform.

14. The method, as recited in claim 9, wherein said first toe spacer is constructed to have a core sleeve and a core support, wherein said core support is extended between said shoe sole and said shoe upper member and coaxially extended along said core sleeve, wherein said two first opposed curving sidewalls are defined at said core sleeve.

* * * * *